US006868772B2

(12) United States Patent
Rice et al.

(10) Patent No.: US 6,868,772 B2
(45) Date of Patent: Mar. 22, 2005

(54) FLUID CONTROL VALVE

(75) Inventors: Steven L. Rice, Englewood, OH (US); Vincent J. Mastrobuono, Vandalia, OH (US); Timothy F. O'Brien, Middletown, NJ (US)

(73) Assignee: IMI Norgren, Inc., Littleton, CO (US)

( * ) Notice: Subject to any disclaimer, the term of this patent is extended or adjusted under 35 U.S.C. 154(b) by 58 days.

(21) Appl. No.: 10/267,179

(22) Filed: Oct. 8, 2002

(65) Prior Publication Data

US 2004/0065190 A1 Apr. 8, 2004

(51) Int. Cl.[7] ..... F15B 11/08
(52) U.S. Cl. ..... 91/420; 137/596.2; 137/543.13
(58) Field of Search ..... 91/420; 137/596.2, 137/543.13

(56) References Cited

U.S. PATENT DOCUMENTS

| | | | | | |
|---|---|---|---|---|---|
| 1,183,981 | A | * | 5/1916 | Johnson | 137/543.13 |
| 2,304,380 | A | * | 12/1942 | Shaeffer | 91/420 |
| 2,362,339 | A | * | 11/1944 | Armington | 91/420 |
| 2,467,508 | A | * | 4/1949 | Trautman | 60/465 |
| 2,483,312 | A | * | 9/1949 | Clay | 91/420 |
| 3,623,509 | A | | 11/1971 | Sesseler et al. | |
| 3,980,000 | A | | 9/1976 | Iijima et al. | 91/411 |
| 3,981,479 | A | | 9/1976 | Foster et al. | 251/63.6 |
| 4,200,031 | A | * | 4/1980 | Skover, Jr. | 91/420 |
| 4,286,432 | A | | 9/1981 | Burrows et al. | 60/404 |
| 4,361,075 | A | | 11/1982 | Block | 91/420 |
| 4,844,114 | A | | 7/1989 | Moberg et al. | 137/115 |
| 5,375,418 | A | | 12/1994 | Shelhart et al. | 60/394 |
| 6,098,647 | A | | 8/2000 | Haussler et al. | 137/102 |
| 6,142,037 | A | * | 11/2000 | Botosan et al. | 137/543.13 |

FOREIGN PATENT DOCUMENTS

| | | | | |
|---|---|---|---|---|
| JP | 55097573 | A | * 7/1980 | F16K/15/18 |

* cited by examiner

*Primary Examiner*—Edward K. Look
*Assistant Examiner*—Igor Kershteyn
(74) *Attorney, Agent, or Firm*—Sheridan Ross P.C.

(57) ABSTRACT

A control valve is provided which may be incorporated within a fluid operating system. The valve has an internally-mounted check element which allows the valve to provide a fail-safe mode for a downstream device in fluid communication with the control valve. The invention includes the control valve, the valve in combination with a downstream device, and a method whereby the flow of pressurized fluid is controlled by operation of the control valve.

19 Claims, 3 Drawing Sheets

FLUID CONTROL VALVE

FIELD OF THE INVENTION

The present invention relates to fluid-control systems, and more specifically, to control valves used in such systems for control of pneumatic or hydraulic devices used in the control systems.

BACKGROUND OF THE INVENTION

Control valves are routinely used to control corresponding pneumatic or hydraulic devices in various industrial applications. Control valves can be incorporated within a complex series of valves for control of a particular manufacturing process, or control valves may be employed individually to control individual pieces of equipment. Common to all control valves is the capability of controlling the supply of a pressurized fluid to a downstream device.

Particularly in manufacturing processes, the loss of fluid system pressure can result in a catastrophic failure of the processes, and various safety devices must be incorporated within the processes to prevent failure. In many instances, the fail-safe mode for a valve dictates that the valve either remain in an open position whereby pressurized fluid may pass through the valve to the downstream device, or the fail-safe mode may dictate that the valve shut off the supply of pressurized fluid. In either case, it is desirable to use control valves which are simple, yet reliable, and can be easily returned to their normal operating modes after an alarm condition has been corrected.

One example of a prior art valve which is used within a manufacturing process for controlled delivery of fluid is U.S. Pat. No. 4,844,114. This reference discloses a pressure-drop sensor valve system for controlling the movement of a fluid operated, ram-type device, such as that used to drive a panel punch. The valve-like device includes a main passage having an inlet for pressurized fluid and an outlet connectable to the ram-type device. Disposed intermediate said inlet and outlet is a fluid chamber. A poppet valve is positioned between said fluid chamber and an accumulator chamber in the body of the device. A fluid by-pass is blocked when the poppet valve is closed and the by-pass is opened when the poppet valve is opened. A piston member is provided with its stem in the accumulator chamber opposite the poppet valve, both said member and valve being slightably movable by separate compression springs. A check valve is positioned in an axial passage of the poppet valve. The poppet valve, check valve, and piston operating in response to fluid pressure variations in the fluid passage and the accumulator chamber caused by pressure demands in the operation of the ramp so as to open the by-pass passage immediately after the punch breaks through the panel and vent pump discharge flow to the reservoir to halt further movement of the ram and punch. The poppet valve may be reset either manually or automatically.

U.S. Pat. No. 3,623,509 discloses a check valve having an internal piston member which controls the flow of pressurized fluid through the valve. The internal piston is operated by fluid flowing through a separate control loop. The piston is able to control the speed at which the check valve is opened, yet allows the check valve to close instantaneously in response to loss of fluid pressure within the fluid operating system. As disclosed in the preferred embodiment, the check valve can be moved from its seated position by contact of a push rod which is moved to disengage a main check valve part by movement of the internal piston. Fluid flowing through the control loop causes the piston to displace, and in turn, the push rod to be displaced for contacting the main check valve part.

U.S. Pat. Nos. 4,286,2 and 5,375,8, both disclose ball type check valves which are spring loaded, and can be influenced between open and closed positions by slidable pistons which contact the balls of the check valves.

Although the foregoing references may be adequate for their intended purposes, the valve of the present invention has certain advantages. Particularly in those applications in which a downstream device to be controlled only requires two positions, (such as open and closed), the valve of the current invention provides the means to effectively control such a device, and also provides a fail-safe mode in the form of an internal check element which maintains the device in its proper fail-safe position. The valve of the present invention is particularly advantageous for use with fluid cylinders. Therefore, the present invention can be also considered as a combination which includes the control valve and a cylinder in fluid communication with the valve.

SUMMARY OF THE INVENTION

In accordance with the present invention, a fluid control valve is provided that is especially adapted for controlling a device used within a pneumatic or hydraulic control system. The construction of the valve is characterized by a valve body having first and second passageways formed therethrough. The passageways carry pressurized fluid which is introduced to the valve by an upstream source of pressurized fluid. A check element is positioned in the first passageway and is movable between a first closed position to block flow of fluid through the first passageway, and a second open position allowing flow through the first passageway. An internal piston member mounted within the valve communicates with both the first and second passageways. The piston member is movable between a retracted position, and an extended position. In the extended position, the piston member contacts the check element to maintain the check element in the second open position. Movement of the piston member to the extended position is controlled by fluid flowing through the second passageway.

As mentioned above, the present invention can also be defined in terms of a combination of the valve, and a device within the pneumatic/hydraulic system which is controlled by the valve. Accordingly, as a combination, fluid which flows through the first passageway results in placing the downstream device in a first state or position, while fluid flowing through the second passageway results in placing the downstream device in a second different state or position. In the event of fluid pressure loss in the pneumatic/hydraulic system, the check element within the valve moves to block flow through the valve thereby stabilizing the device until fluid pressure is restored.

Yet another aspect of the invention includes a method of controlling fluid flow through a pneumatic/hydraulic system whereby a valve operates or controls a specific device in fluid communication with the valve. One characteristic of the method of the invention involves the use of a check element in the valve which blocks flow of fluid through the valve in the event of the loss of fluid pressure.

In addition to the valve of the present invention having a simple, yet effective design, the valve also provides for a fail-safe mode or condition which does not require a separate control loop, or any additional fluid passageways formed in the valve to effectuate the fail-safe mode or condition.

Additional advantages will become apparent from a review of the following description of the invention, taken in conjunction with the accompanying drawings.

DETAILED DESCRIPTION

Figure 1:
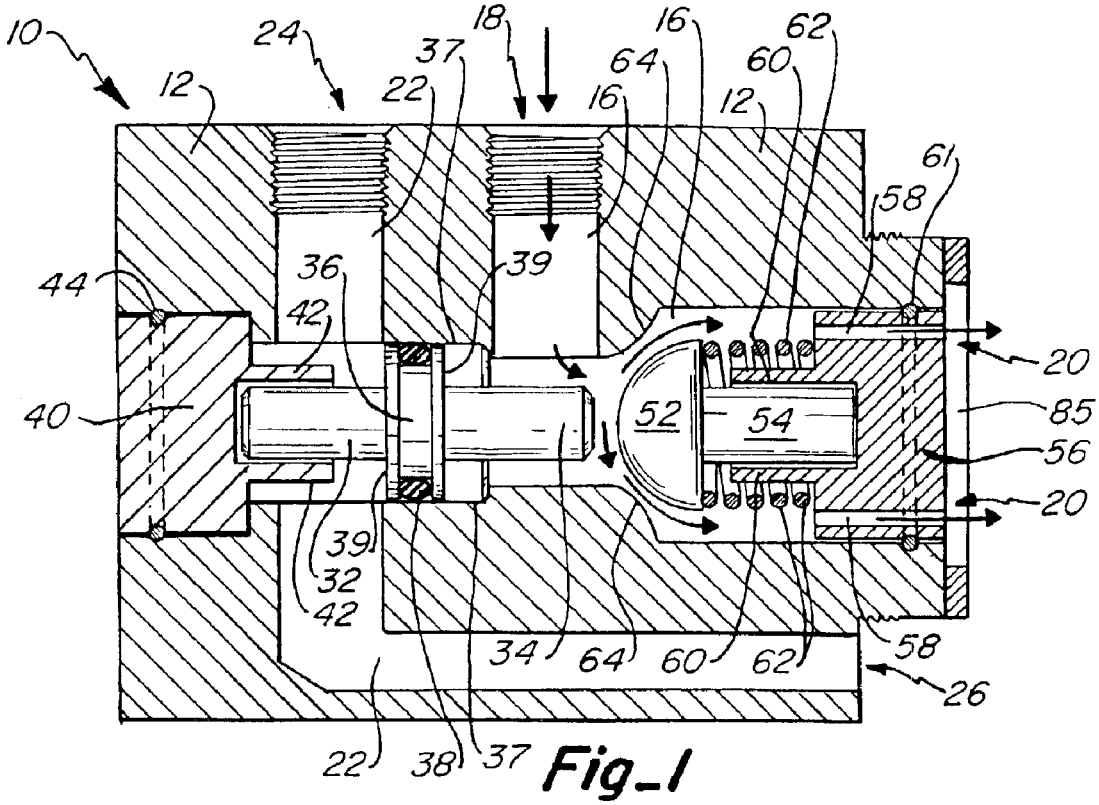
FIG. 1 is a cross-sectional view of the valve of the present invention showing fluid flowing through a first passageway which maintains the check element in its open or unseated position.

FIG. 1 illustrates the valve of the present invention, and the internal working components of the valve. The valve 10 includes a valve body 12 which houses the components of the valve, and provides structure for attachment to a device which is to be controlled by the valve. The valve body may be a machined or cast part. A first passageway 16 is formed through the valve body 12. The first passageway 16 has an inlet 18 for receiving a pressurized flow of fluid and an outlet 20 that allows fluid to exit the passageway 16. A second passageway 22 is also formed through the valve body 12, the second passageway having its own inlet 24, and outlet 26. An internal piston element is positioned within the valve body, and communicates with both the first and second passageways. The piston element has a first end 32 which remains in communication with the second passageway, while a second end 34 of the piston remains in communication with the first passageway. The piston further includes a centrally mounted plug 36 which allows the piston 32 to slide within transverse bore 37 surrounding the plug. As shown, transverse bore 37 extends substantially perpendicular to the section of the second passageway 22 which intersects with the first end 32 of the piston. The transverse bore 37 defines an opening allowing the second end of the piston member to be located within the first passageway. An O-ring type seal 38 may be installed between the radial flanges or extensions 39 of plug 36 to insure that there is a fluid tight seal preventing leakage of fluid between the first and second passageways through the transverse bore 37.

The slidable movement of the piston is stabilized by a piston receiver 40 which also intersects transversely with the second passageway. The piston receiver 40 includes a cylindrical extension 42 which is aligned in parallel fashion with the transverse bore 37, the cylindrical extension 42 forms an opening for receiving the first end 32 of the piston. As shown, the piston receiver 40 is introduced in the body of the valve through an opening formed in the valve body. A seal 44 may be placed around the exterior edge of the receiver 40 in order to maintain a leak proof relationship between the valve body and the receiver 40.

A check element is disposed within the first passageway. The check element includes a head 52, and a stem 54 extending away from the head. The check element is slidable within the first passageway depending upon the fluid flow therethrough. Preferably, the head 52 is substantially aligned with the second end 34 of the piston wherein both the piston and the check element are slidable along a common axis. The check element is mounted within the first passageway by check valve receiver 56 which is introduced within the valve body by an opening formed in the valve body. The construction of the check valve receiver 56 is similar to that of the piston receiver. The check valve receiver 56 also includes a cylindrical extension 60 which receives the stem 54. Fluid is able to flow beyond the check valve receiver 56 by a plurality of passageways 58 which are formed through the receiver 56. A retaining ring 61 prevents leakage of fluid between the receiver 56 and the passageway. Alternatively, the diameter of the receiver 56 could be slightly smaller than of the diameter of the opening which receives the receiver 56, and the receiver 56 would be held within the opening as by a flange (not shown), which could extend radially beyond the receiver 56 and would frictionally engage the opening. The flange would not traverse the entire circumference of the opening, but rather would have gaps allowing fluid flow therethrough.

FIG. 1 illustrates the flow of fluid through passageway 16, the flow being denoted by the directional arrows. As shown, fluid enters inlet 18, flows through the first section or portion of passageway 16, beyond the second end 34 of the piston, past the head 52 of the check, through/beyond the receiver 56 and finally through outlet 20. The flow of fluid in this manner is achieved by fluid pressure which is great enough to overcome the force of spring 62 which normally urges the check element to the left as viewed in FIG. 1. Thus, the check element is shown in its open position. As discussed below with reference to FIG. 3, if the force of the spring 62 overcomes the force of the fluid flowing through the first passageway, then the check closes off the first passageway by contact of the head 52 against the seat 64 which is a portion of the inner surface defining the passageway 16.

In the position shown at FIG. 1, the piston element is shown in its retracted position whereby the first end 32 is fully seated within the opening formed by the extension 42. Depending upon the flow rate of fluid through the first passageway, the piston element could be influenced to translate or move to a partially or fully extended position. This influence could be caused by the force of the fluid which would urge or pull the second end 34 towards the check element. Even if the piston moved, fluid would continue to pass through the first passageway so long as the force of the fluid continued to overcome the force of the spring 62. Thus, slight or even full translation of the piston would have minimal consequences.

Figure 2:
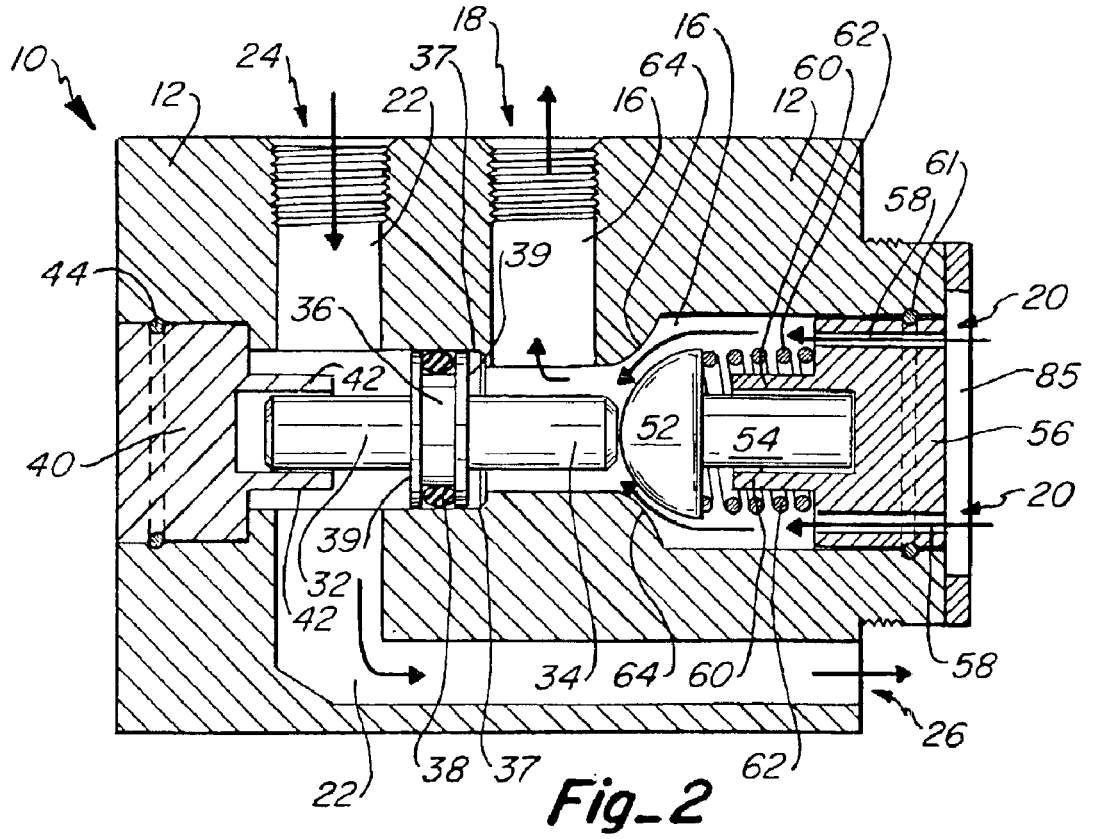
FIG. 2 is another cross-sectional view of the valve of the present invention showing fluid flowing through a second passageway, and further wherein the check element is maintained in its open or unseated position, thereby also allowing fluid return back through the first passageway.

Now referring to FIG. 2, a pressurized flow of fluid is introduced through the second passageway 22. The pressurized flow of fluid urges the piston element to the right, thereby causing the second end 34 of the piston to contact the head 52, thus preventing the head 52 from blocking flow through the first passageway. Although fluid passing through the second passageway is in a direction substantially perpendicular to the direction of sliding movement of the piston, the transverse bore 37 provides an area within the second passageway that allows the fluid to place pressure against the plug 36 in a direction to facilitate slidable movement. The size of the bore 37 and plug 36 could be therefore adjusted in order to vary the amount of force which is transferred to the piston for slidable movement of the piston. Increasing the size of the bore 37 and plug 36 would be one manner in which to increase the amount of force that could be transferred by the piston to the head 52. As discussed below with reference to FIG. 4, when the valve is attached to the field device to be controlled, the flow of fluid through the second passageway ultimately allows fluid flow back through the first passageway in an opposite direction from the fluid flow shown in FIG. 1. As with the fluid flow shown in FIG. 1, the fluid flow introduced through the second passageway also must be of a magnitude so that the force of the piston can keep the check element from moving to its closed position.

Figure 3:
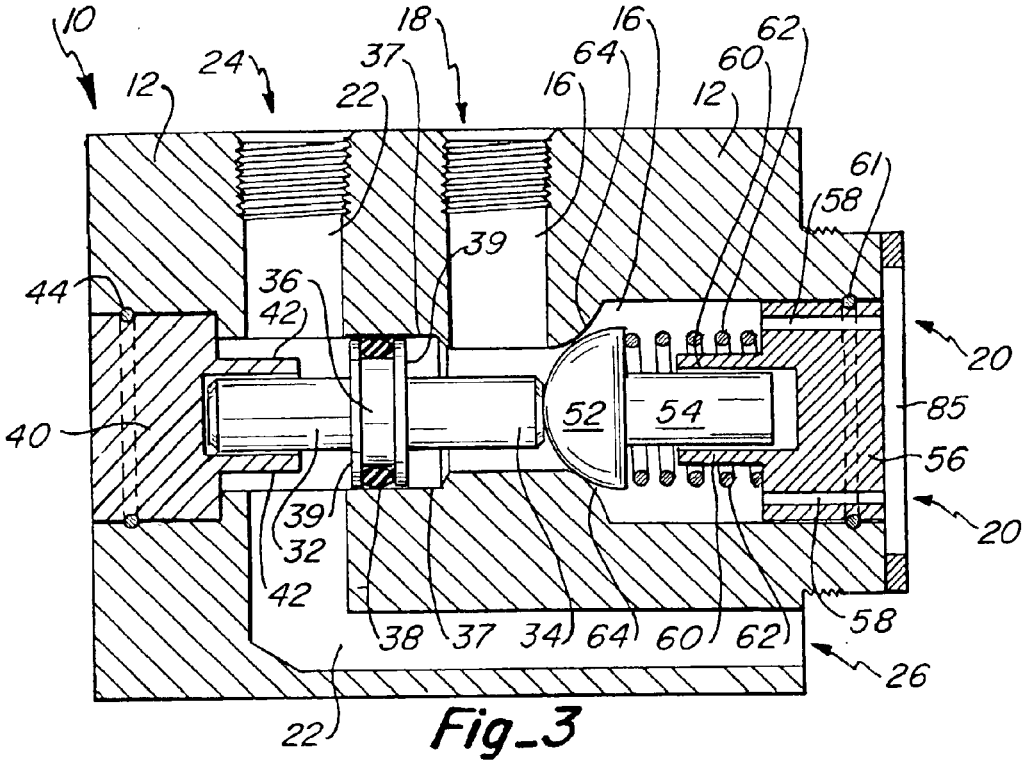
FIG. 3 is yet another cross-sectional view of the valve wherein fluid pressure has been lost in the system, thereby allowing the check element to move to its closed or seated position that maintains a steady state of fluid pressure to a fluid-operated device in communication with the valve.

Now referring to FIG. 3, this figure illustrates a condition in which there has been a complete loss of fluid pressure in the system, or fluid flow through the valve is overcome by the force of the spring 62. In this condition, the head 52 becomes seated against seat 64 thereby blocking any flow through the first passageway. Accordingly, any fluid downstream of the check element in communication with the first passageway will be maintained in a steady state since there can be no further flow of fluid through the first passageway.

Figure 4:
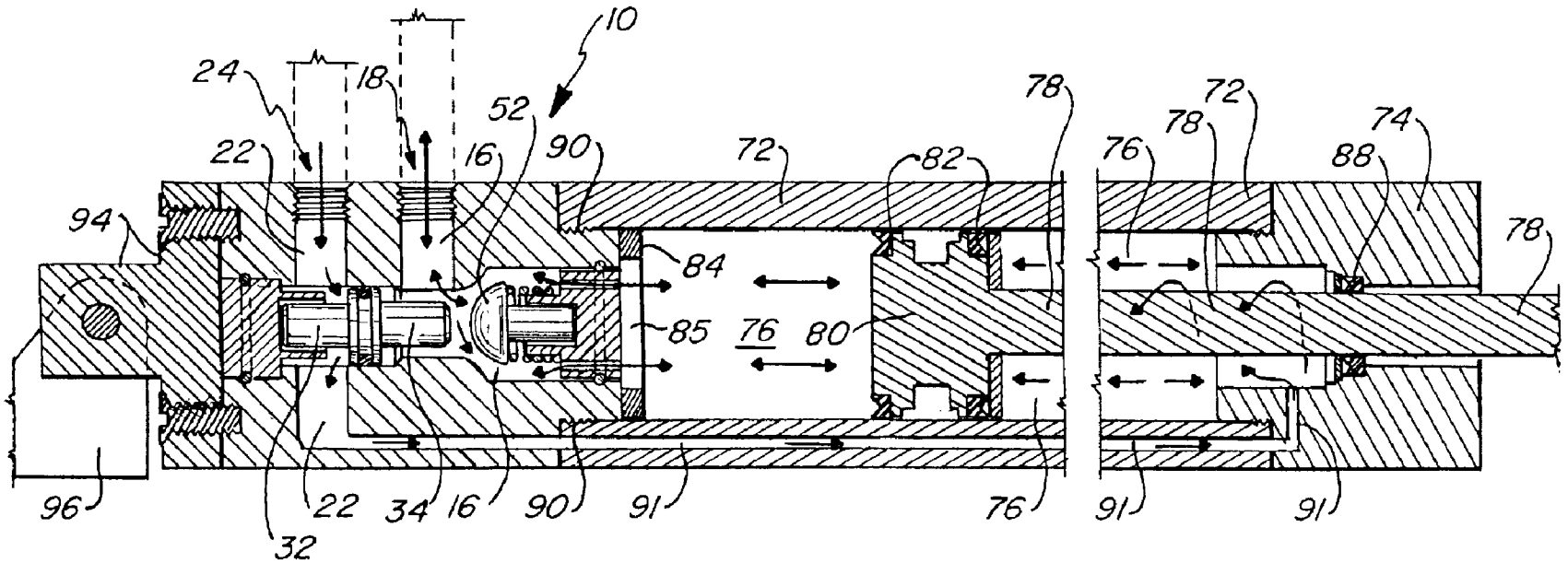
FIG. 4 is a fragmentary, cross-sectional view of the valve which is used in conjunction with a fluid-operated device, such as a hydraulic or pneumatic cylinder.

FIG. 4 illustrates the valve 10 used to control a common pneumatic/hydraulic device, such as a cylinder. The cylinder 70 is defined by a sleeve/body 72, an end cap 74, a chamber 76 formed in the sleeve 72, and a rod 78 positioned in the chamber. A plunger 80 connects to the base of the rod 78, and separates the chamber 76 into two sides. As well understood by those skilled in the art, fluid pressure which enters the chamber 76 to left of plunger 80 urges the rod towards the right, thereby extending the rod 78 away from the sleeve. Fluid pressure introduced within the chamber 76 to the right of plunger 80 causes the rod 78 to retract back within the cylinder. Plunger 80 has one or more seals 82 which insures that integrity is maintained in preventing fluid flow around the plunger 80. The end of the cylinder 70 which connects to the valve 10 may further include a plug or stop 84 having an opening 85 formed therethrough, which communicates with the chamber 76. The plug or stop 84 delimits the retracted position of the rod 78. Conveniently, the valve 10 may be sized to mate with the cylinder 70, and any well known connection may be provided for secure attachment of the valve 10 to the cylinder 70, such as a threaded connection 90. The first passageway 16 is aligned with the opening 85 in the plug 84, thereby allowing fluid to flow within the chamber 76 on the left side of the plunger 80 according to the view in FIG. 4. The cylinder 70 also has a longitudinal passageway 91 which aligns with the second passageway 22 when the valve and cylinder are connected. Passageway 91 allows a flow of fluid to be introduced within the chamber 76 on the right side of plunger 80 according to the view of FIG. 4. Seal 88 prevents the flow of fluid from passageway 91 from exiting the chamber.

When fluid is introduced through the first passageway at a pressure which overcomes the spring 62, fluid is allowed to flow through the valve and into the chamber 76 thereby causing the rod 78 to extend. If the pressurized fluid is no longer introduced through the first passageway and rather is introduced through the second passageway at a force whereby the piston overcomes the spring 62 and maintains the check element in the open position, then fluid flows through passageway 91 and is then introduced into the chamber 76 on the right side of the plunger thereby causing the rod 78 to retract back within the chamber 76. As the rod 78 retracts, fluid is forced back through the first passageway in a reverse direction. Thus, the extension and retraction of the rod 78 may be controlled by fluid flowing through the first and second passageways. An upstream control element such as PLC (not shown) would dictate the duration and volume of fluid flowing through the first and second passageways, thereby achieving the exact desired positioning of the rod 78.

In the event there was a loss of fluid pressure, the check would move to its seated position, thereby preventing the rod 78 from retracting. When proper operation of the system was again restored by the desired fluid flow through the passageways, the check would be removed from its seated position. When fluid flow was restored at a sufficient pressure through the second passageway 22 to overcome the spring 62, the piston would unseat the check. Conversely, fluid flow restored through the first passageway 16 at a sufficient pressure to overcome the spring 62 would also unseat the check.

Figure 5:
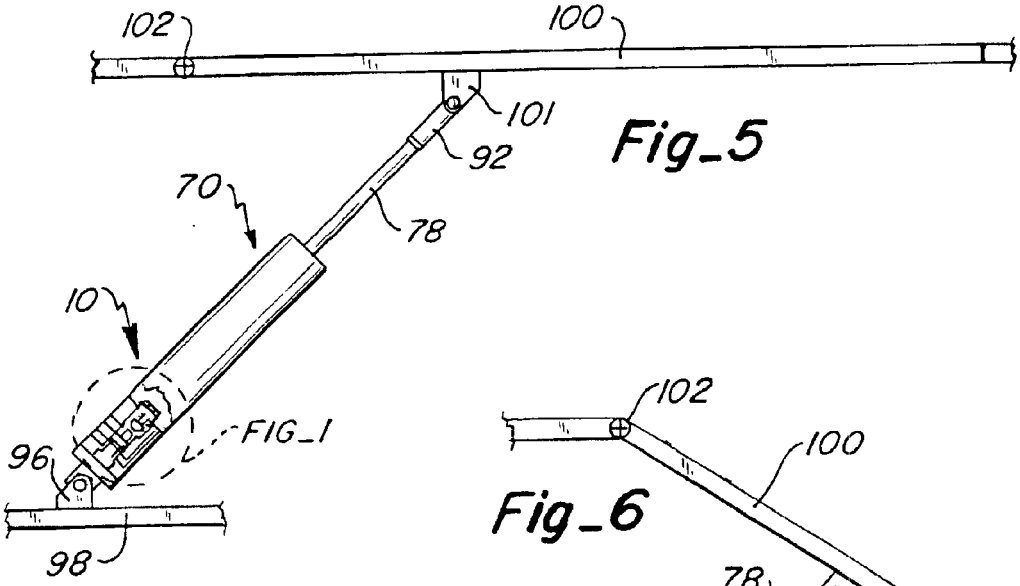
FIGS. 5 and 6 are fragmentary, cross-sectional views of the combination of the valve and the fluid-operated device, wherein the fluid-operated device is installed for use in opening and closing a gate or trap door used within a manufacturing process.
Figure 6:
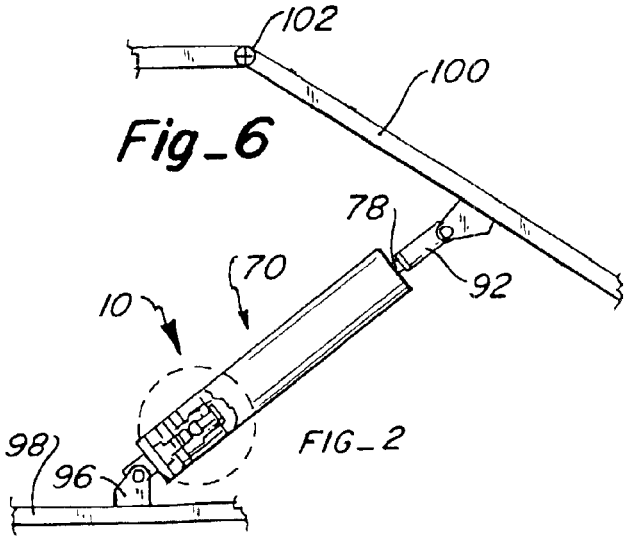

FIGS. 5 and 6 illustrate the valve 10 and the cylinder 70 installed in a system or process whereby the retraction and extension of rod 78 results in the opening/closing of a trap door 100. The valve 10 may be mounted to a base 94 which in turn is attached to a mounting bracket 96. The mounting bracket 96 can be mounted to a surface 98 which is in close proximity to the area to be controlled. Linkage 92 can be used to interconnect the free end of rod 78 to a mounting bracket 101 that attaches to the trap door 100. The trap door 100 is shown as rotating about hinge point 102.

One example scenario involving use of the trap door would be a manufacturing process in which an amount of product is stored above the trap door 100, and periodically, it is necessary to open the trap door 100 to allow the product to flow past the trap door to a next stage of processing. Accordingly, the rod 78 would be extended or retracted to accommodate closing or opening of the trap door. In the event of loss of fluid pressure, assuming the trap door was already closed, the trap door 100 would be maintained in its closed position since loss of fluid pressure would cause the check to close thereby preventing retraction of the rod 78. Accordingly, there would be no loss of product because the trap door 100 would remain closed.

FIGS. 4–6 illustrate but one example of a fluid-operated device which may be used in conjunction with the valve of the present invention. Those skilled in the art can envision any number of other types of fluid operated devices which can also be controlled by the valve of the present invention, wherein the check element provides for a fail-safe position.

In accordance with the method of the present invention, a valve is provided whereby fluid flow through two distinct passageways may control a downstream device in fluid communication with the valve. Loss of fluid pressure through the valve results in activation of the internal check element to hold or maintain the downstream device in its condition just prior to loss of fluid pressure. The internally-mounted piston provides a means by which the check may be deactivated, thereby eliminating the need for a separate fluid control loop or an additional device for deactivating the check.

The foregoing invention has been described with respect to a preferred embodiment; however, various changes and modifications may be made which fall within the spirit and scope of the invention.

What is claimed is:

1. A valve for controlling fluid flow to a fluid operated device, said valve comprising:

a valve body having first and second passageways formed therethrough and facilitating fluid flow in a first direction and a second opposite direction;

a check element positioned longitudinally in said first passageway, said check element having first and second ends, said check element being movable between a first closed position to block flow of fluid through said first passageway and said check element being movable to a second open position when fluid flows through said first passageway in the second opposite direction and around said check element from said first end beyond said second end thereof;

a piston member having first and second ends and mounted transversely in said second passageway, said piston being movable between a retracted position when fluid flows through said second passageway in said second opposite direction and in contact and around said piston member, and an extended position when fluid flows in said first direction through said second passageway and wherein said second end of said piston member extends into said first passageway and contacts said check element to maintain said check element in the second open position, a piston receiver mounted in said valve body adjacent said second passageway and transversely disposed in said second passageway, said piston receiver for receiving said first end of said piston element, said piston receiver facilitates slidable movement of said piston element between said retracted and extended positions, and said piston receiver delimits said retracted position of said piston member.

2. A valve, as claimed in claim 1, further comprising:

a check valve receiver positioned in said first passageway for receiving said check element thereby stabilizing said check element in said first passageway, and facilitating slidable movement between said first closed and second open positions.

3. A valve, as claimed in claim 1, further including:

means for biasing said check element to urge said check element to said first closed position, said means for biasing being mounted in said first passageway adjacent said check element.

4. A valve, as claimed in claim 1, wherein:

said first passageway is defined by a first inlet, a first outlet, and means interconnecting said first inlet and first outlet thereby forming a continuous opening through said valve body.

5. A valve, as claimed in claim 1, wherein:

said second passageway is defined by a second inlet, a second outlet, and means interconnecting said second inlet and said second outlet thereby forming a continuous opening through said valve body.

6. A valve, as claimed in claim 1, wherein:

said check element includes a stem portion, and an enlarged head portion connected to said stem portion.

7. A valve, as claimed in claim 1, further comprising:

means for sealing said piston member to prevent fluid flow between said first and second passageways via an opening which receives said piston member.

8. A valve, as claimed in claim 1, further comprising:

the fluid operated device in combination with said valve, said fluid operating device communicating with said first passageway to receive the flow of fluid therethrough, said fluid operated device having a rod being extendable and retractable in a range of positions based upon the volume of fluid flow through the first passageway.

9. A valve for controlling fluid flow to a fluid operated device, said valve comprising:

a valve body having first and second passageways formed therethrough and facilitating fluid flow in a first direction and a second opposite direction;

a check element positioned longitudinally in said first passageway, said check element having first and second ends, said check element being movable between a first closed position to block flow of fluid through said first passageway, and said check element being movable to a second open position when fluid flows through said first passageway in the second opposite direction and around said check element from said first end beyond said second end thereof; and means mounted in said valve body for operating said check element to selectively position said check element either in the first closed or the second open position, said operating means having first and second ends, and being mounted transversely in said second passageway, said operating means being movable between a retracted position when fluid flows in said second opposite direction through said second passageway and in contact and around said operating means, and an extended position when fluid flows in said first direction through said second passageway and wherein said second end of said operating means extends into said first passageway and contacts the check element to maintain the check element in the second open position, a piston receiver mounted in said valve body adjacent said second passageway and transversely disposed in said second passageway, said piston receiver for receiving said first end of said piston element, said piston receiver facilitates slidable movement of said piston element between said retracted and extended positions, and said piston receiver delimits said retracted position of said piston member.

10. A valve, as claimed in claim 9, further comprising:

a check valve receiver positioned in said first passageway for receiving said check element thereby stabilizing said check element in said first passageway, and facilitating slidable movement between said first closed and second open positions.

11. A valve, as claimed in claim 9, further including:

means for biasing said check element to urge said check element to said first closed position, said means for biasing being mounted in said first passageway adjacent said check element.

12. A valve, as claimed in claim 9, wherein:

said first passageway is defined by a first inlet, a first outlet, and means interconnecting said first inlet and first outlet thereby forming a continuous opening through said valve body.

13. A valve, as claimed in claim 9, wherein:

said second passageway is defined by a second inlet, a second outlet, and means interconnecting said second inlet and said second outlet thereby forming a continuous opening through said valve body.

14. A valve, as claimed in claim 9, wherein:

said check element includes a stem portion, and an enlarged head portion connected to said stem portion.

15. A valve, as claimed in claim 9, further comprising:

means for sealing said operating means to prevent fluid flow between said first and second passageways via an opening which receives said operating means.

16. A valve, as claimed in claim 9, further comprising:

the fluid operated device in combination with said valve, said fluid operating device communicating with said first passageway to receive the flow of fluid therethrough, said fluid operated device having a rod being extendable and retractable in a range of positions based upon the volume of fluid flow through the first passageway.

17. A valve for controlling fluid flow to a fluid operated device, said valve comprising:

a valve body having first and second passageways formed therethrough;

a check element positioned in said first passageway and movable between a first closed position to block flow of fluid through said first passageway, and a second open position allowing flow through said first passageway;

a piston member communicating with said first and second passageways, said piston being movable between a retracted position, and an extended position wherein said piston member contacts said check element to maintain said check element in the second open position, said piston member being moved to the extended position by fluid flowing through said second passageway means for biasing said check element to urge said check element to said first closed position, said means for biasing being mounted in said first passageway adjacent said check element; and receiving means mounted transversely in said second passageway, said receiving means receiving said piston element thereby facilitating slidable movement of said piston element transversely in said second passageway between said retracted and extended positions.

18. A valve, as claimed in claim 17, further comprising:

a check valve receiver positioned in said first passageway for receiving said check element thereby stabilizing said check element in said first passageway, and facilitating slidable movement of the check element between said first closed and said second open positions.

19. A valve, as claimed in claims 17, further comprising:

means for sealing said piston member to prevent fluid flow between said first and second passageways via an opening through which said piston member extends.

* * * * *